US007926895B2

(12) United States Patent
Ishikawa et al.

(10) Patent No.: US 7,926,895 B2
(45) Date of Patent: Apr. 19, 2011

(54) PRINTING APPARATUS AND CONVEYANCE CONTROL METHOD

(75) Inventors: Tetsuya Ishikawa, Yokohama (JP); Haruyuki Yanagi, Machida (JP); Kentaro Onuma, Yokohama (JP); Hiroyuki Saito, Yokohama (JP); Hideo Sugimura, Tokyo (JP); Masakazu Tsukuda, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 796 days.

(21) Appl. No.: 11/842,573

(22) Filed: Aug. 21, 2007

(65) Prior Publication Data

US 2008/0049089 A1 Feb. 28, 2008

(30) Foreign Application Priority Data

Aug. 23, 2006 (JP) ..... 2006-227016

(51) Int. Cl.
*B41J 29/38* (2006.01)

(52) U.S. Cl. ..... 347/16; 347/19

(58) Field of Classification Search ..... None
See application file for complete search history.

(56) References Cited

U.S. PATENT DOCUMENTS

| | | | | |
|---|---|---|---|---|
| 5,602,571 | A | 2/1997 | Suda et al. | |
| 6,095,703 | A | 8/2000 | Tanaka et al. | |
| 6,168,333 | B1 | 1/2001 | Merz et al. | 400/634 |
| 6,655,865 | B2 | 12/2003 | Yanagi et al. | 400/705 |
| 6,685,370 | B2 | 2/2004 | Hiramatsu | |
| 6,761,425 | B2 | 7/2004 | Kawaguchi | 347/16 |
| 7,014,378 | B2 | 3/2006 | Saito et al. | 400/582 |
| 7,021,737 | B2 | 4/2006 | Yamada | |
| 7,093,917 | B2 | 8/2006 | Yamada | 347/19 |
| 7,189,018 | B2 | 3/2007 | Cercos et al. | |
| 7,195,239 | B2 | 3/2007 | Saito et al. | 271/256 |
| 7,290,763 | B2 | 11/2007 | Suzuki et al. | |
| 7,367,733 | B2 | 5/2008 | Bedzyk et al. | |
| 7,401,913 | B2 | 7/2008 | Nishiberi et al. | |

(Continued)

FOREIGN PATENT DOCUMENTS

CN 1060432 4/1992

(Continued)

OTHER PUBLICATIONS

Official Letter/Search Report issued by the European Patent Office, on Nov. 26, 2007, in European Patent Application No. 07016478.5.

(Continued)

*Primary Examiner* — Matthew Luu
*Assistant Examiner* — Justin Seo
(74) *Attorney, Agent, or Firm* — Fitzpatrick, Cella, Harper & Scinto

(57) ABSTRACT

This invention relates to a printing apparatus and a conveyance control method capable of allowing even an arrangement having a plurality of conveyance rollers in a printing medium conveyance path to accurately control conveyance of a printing medium. A pattern having a predetermined uniform density is printed on a printing medium a plurality of number of times by using a printhead while conveying the printing medium and changing the conveyance amount by a small amount. A conveyance correction amount obtained on the basis of the conveyance amount upon printing a pattern selected from a plurality of printed pattern is stored in a storage medium. Conveyance of the printing medium is controlled while correcting the conveyance amount of the printing medium by the conveyance means on the basis of the conveyance correction amount stored in the storage means.

10 Claims, 9 Drawing Sheets

U.S. PATENT DOCUMENTS

| | | | | |
|---|---|---|---|---|
| 7,410,167 | B2 | 8/2008 | Koga et al. | |
| 7,597,322 | B2 | 10/2009 | Suzuki et al. | |
| 2001/0055054 | A1 | 12/2001 | Kosaka et al. | |
| 2003/0025922 | A1* | 2/2003 | Otsuki | 358/1.2 |
| 2005/0012800 | A1* | 1/2005 | Ohashi | 347/104 |
| 2006/0033943 | A1 | 2/2006 | Yanagi | 358/1.13 |
| 2007/0007711 | A1 | 1/2007 | Suzuki et al. | |
| 2007/0172296 | A1* | 7/2007 | Igarashi | 400/625 |
| 2008/0006984 | A1 | 1/2008 | Kakishima | |
| 2008/0008513 | A1 | 1/2008 | Kakishima et al. | |

FOREIGN PATENT DOCUMENTS

| | | | |
|---|---|---|---|
| CN | 1496854 | | 5/2004 |
| EP | 1 666 263 | A1 | 6/2006 |
| JP | 08-142431 | | 6/1996 |
| JP | 2002-225370 | | 8/2002 |
| JP | 2002-254736 | | 9/2002 |
| JP | 2002-361958 | | 12/2002 |
| JP | 2004-122362 | | 4/2004 |
| JP | 2004202962 | A * | 7/2004 |
| JP | 2005-131928 | | 5/2005 |
| JP | 2005-132028 | | 5/2005 |
| JP | 2006-82425 | | 3/2006 |
| JP | 2006-170745 | | 6/2006 |

OTHER PUBLICATIONS

U.S. Appl. No. 11/842,532, filed Aug. 21, 2007, Haruyuki Yanagi, et al.

U.S. Appl. No. 11/842,553, filed Aug. 21, 2007, Hiroyuki Saito, et al.

Official Action (Translation), dated May 8, 2009, issued by the Chinese Patent Office, in Chinese Patent Application No. 200710146593.2.

* cited by examiner

PRINTING APPARATUS AND CONVEYANCE CONTROL METHOD

BACKGROUND OF THE INVENTION

1. Field of the Invention

The present invention relates to a printing apparatus and a conveyance control method. Particularly, the present invention relates to a printing apparatus and a conveyance control method which perform accurate conveyance control even when, e.g., the leading edge or trailing edge of a printing medium enters between or passes through conveyance rollers.

2. Description of the Related Art

Recent printing apparatuses such as printers use not only plain paper but also printing media such as photo special paper to print photo images in many occasions. In particular, an inkjet printer which uses smaller ink droplets for printing can obtain an image quality equal to or higher than a film photo.

Accordingly, conveyance of printing media is also required to be accurate. Conveyance rollers use precision rollers with, e.g., a grindstone coating on a metal shaft. A DC motor used to drive the conveyance rollers is controlled by a cord wheel and an encoder sensor provided coaxially, thereby simultaneously ensuring high accuracy and high-speed conveyance.

Only one pair of conveyance rollers does not suffice for accurate printing of an image up to the trailing edge of a printing medium. To implement, e.g., marginless print, some proposed arrangements have another pair of conveyance rollers downstream in the printing medium conveyance direction. The mechanical accuracy of the conveyance roller pair downstream in the conveyance direction is also raised to ensure the conveyance accuracy (Japanese Patent Publication Laid-Open No. 2002-225370).

Additionally, to meet the growing requirements for a higher printed image quality and a higher printing speed, the print width of a printhead increases, the number of passes of multipass printing decreases, and the printing medium conveyance length of each pass printing increases. To attain higher image quality, ink droplets to be used in printing become smaller. This also indicates that it is necessary to more accurately convey a printing medium.

In this case, conventionally, encoder sensor control is applied to the above-described precision rollers to maintain accurate conveyance. However, in a printer having another conveyance roller pair downstream in the conveyance direction of a printing medium to cope with, e.g., marginless printing, after the trailing edge of a printing medium passes through the upstream conveyance rollers, when the downstream conveyance rollers solely convey the printing medium, drive transmission via, e.g., an idler gear also gets involved. The conventional arrangement that performs conveyance control by using only the encoder sensor output of the upstream precision rollers can hardly ensure the conveyance accuracy. To ensure the accuracy, the number of use nozzles of the printhead must be restricted. This is a great obstacle in speeding up printing.

To solve this problem, an arrangement has been proposed in which a cord wheel is coaxially provided even on the downstream conveyance roller to perform conveyance control using another encoder sensor. That is, the roller positions are detected by a plurality of encoder sensors, thereby ensuring high accuracy in the entire conveyance mechanism.

In the above prior art, however, the conveyance accuracy is lower in an area where conveyance is performed by a conveyance roller other than the main conveyance roller (e.g., precision roller) compared to an area where the main conveyance roller performs conveyance. For this reason, the area where conveyance is performed by a conveyance roller other than the main conveyance roller is reduced as much as possible with respect to the area of a whole printing medium. Thus, in a case where a conveyance correction amount is to be acquired by printing an adjustment pattern as described in Japanese Patent Publication Laid-Open No. 2004-122362, if the number of times of conveyance operations of a printing medium is very small, and/or if plural times of conveyance operations is performed, the print width per cycle must be very narrow. It is consequently difficult to detect an optimum correction amount from the printed adjustment pattern.

SUMMARY OF THE INVENTION

Accordingly, the present invention is conceived as a response to the above-described disadvantages of the conventional art.

For example, a printing apparatus and a conveyance control method according to this invention are capable of, e.g., allowing even an arrangement having a plurality of conveyance rollers in a printing medium conveyance path to accurately control conveyance of a printing medium.

According to one aspect of the present invention, preferably, there is provided a printing apparatus which includes conveyance means for conveying a printing medium, and scanning means for moving a printhead in a direction different from a conveyance direction by the conveyance means, and causes the printhead to print on the printing medium while causing the scanning means to move the printhead, the apparatus comprising: pattern printing means for printing a pattern having a predetermined uniform density on the printing medium a plurality of number of times by using the printhead while conveying the printing medium and changing a conveyance amount by the conveyance means by a small amount; storage means for storing a conveyance correction amount obtained on the basis of a conveyance amount upon printing a pattern selected from a plurality of patterns printed by the pattern printing means; and conveyance control means for controlling conveyance of the printing medium while correcting the conveyance amount of the printing medium by the conveyance means on the basis of the conveyance correction amount stored in the storage means.

According to another aspect of the present invention, preferably, there is provided a conveyance control method of a printing apparatus which includes conveyance means for conveying a printing medium, and scanning means for reciprocally moving a printhead in a direction different from a conveyance direction by the conveyance means, and causes the printhead to print on the printing medium, the method comprising steps of: printing a pattern having a predetermined uniform density on the printing medium a plurality of number of times by using the printhead while conveying the printing medium and changing a conveyance amount by the conveyance means by a small amount; storing, in a storage medium, a conveyance correction amount obtained on the basis of a conveyance amount upon printing a pattern selected from a plurality of patterns printed in the pattern printing step; and controlling conveyance of the printing medium while correcting the conveyance amount of the printing medium by the conveyance means on the basis of the conveyance correction amount stored in the storage medium.

The invention is particularly advantageous since an optimum conveyance correction amount can be set on the basis of a plurality of patterns actually printed on a printing medium, and satisfactory conveyance can be implemented throughout the entire area of the printing medium. This results in satisfactory image printing over an entire printing area.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink (e.g., can solidify or insolubilize a coloring agent contained in ink applied to the print medium).

Furthermore, unless otherwise stated, the term "nozzle" generally means a set of a discharge orifice, a liquid channel connected to the orifice and an element to generate energy utilized for ink discharge.

Figure 1:
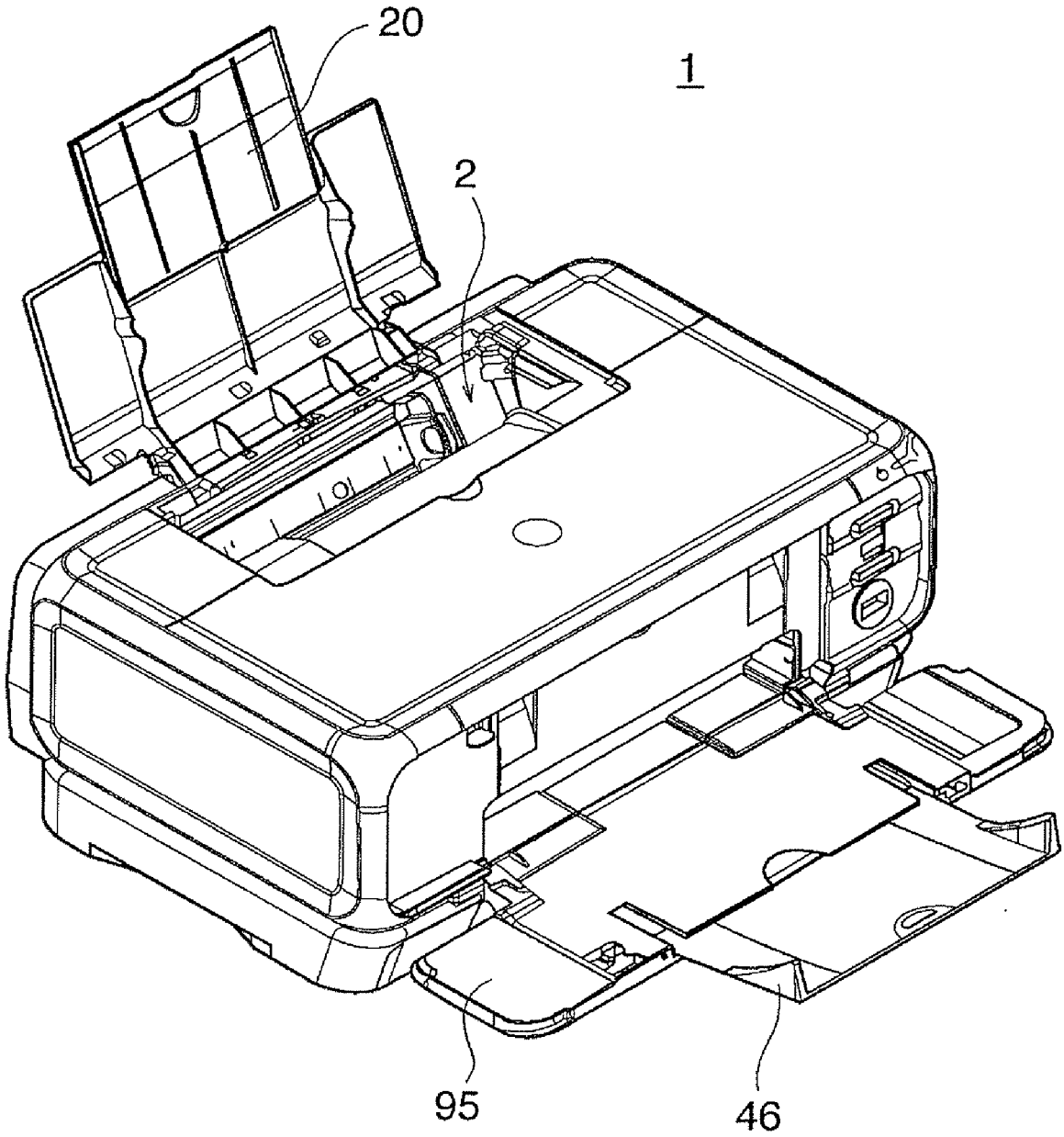
FIG. 1 is a schematic perspective view of a printing apparatus of a typical embodiment of the present invention, which prints by using an inkjet printhead.

FIG. 1 is a schematic perspective view of a printing apparatus of a typical embodiment of the present invention, which prints using an inkjet printhead.

Figure 2:
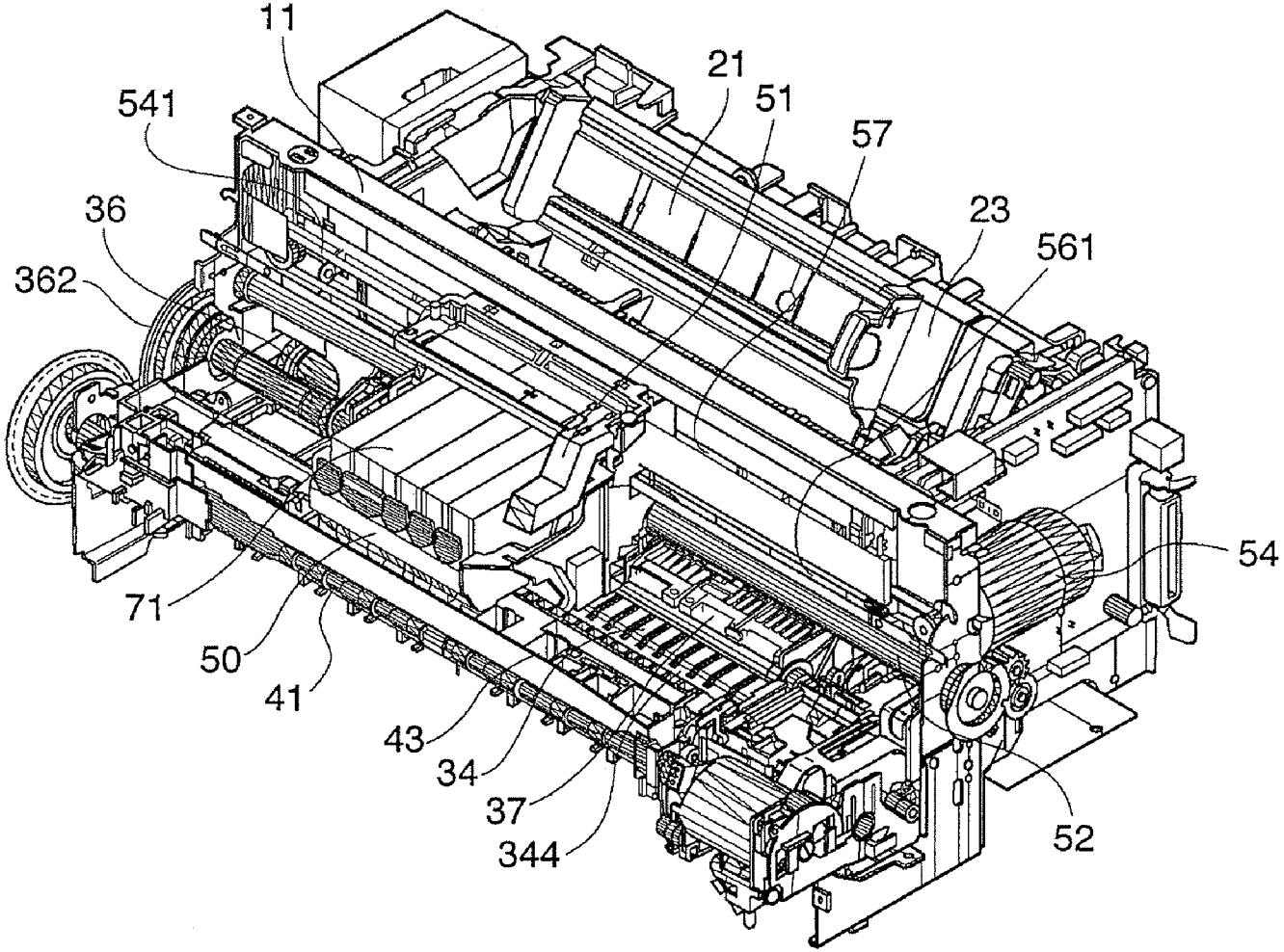
FIG. 2 is a schematic perspective view showing the internal structure of the printing apparatus in FIG. 1 without the outer case.

FIG. 2 is a schematic perspective view showing the internal structure of the printing apparatus in FIG. 1 without the outer case. For example, the printing apparatus forms an image on a printing medium by repeatedly conveying the printing medium by a predetermined amount and scanning a carriage with a printhead.

Figure 3:
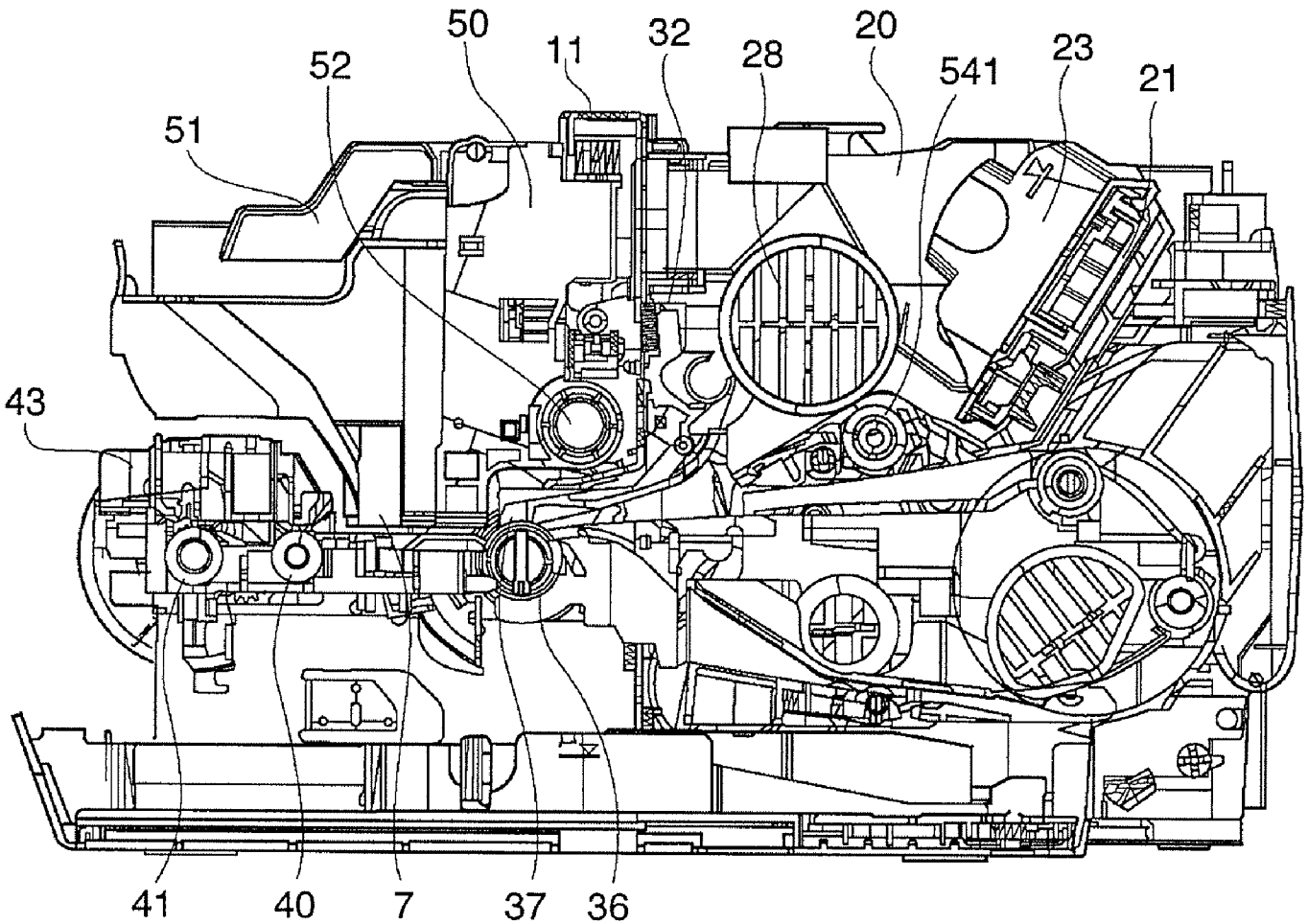
FIG. 3 is a side sectional view showing a printing medium conveyance mechanism in the internal structure of the printing apparatus in FIG. 2.

FIG. 3 is a side sectional view showing a printing medium conveyance mechanism in the internal structure of the printing apparatus in FIG. 2.

Figure 4:
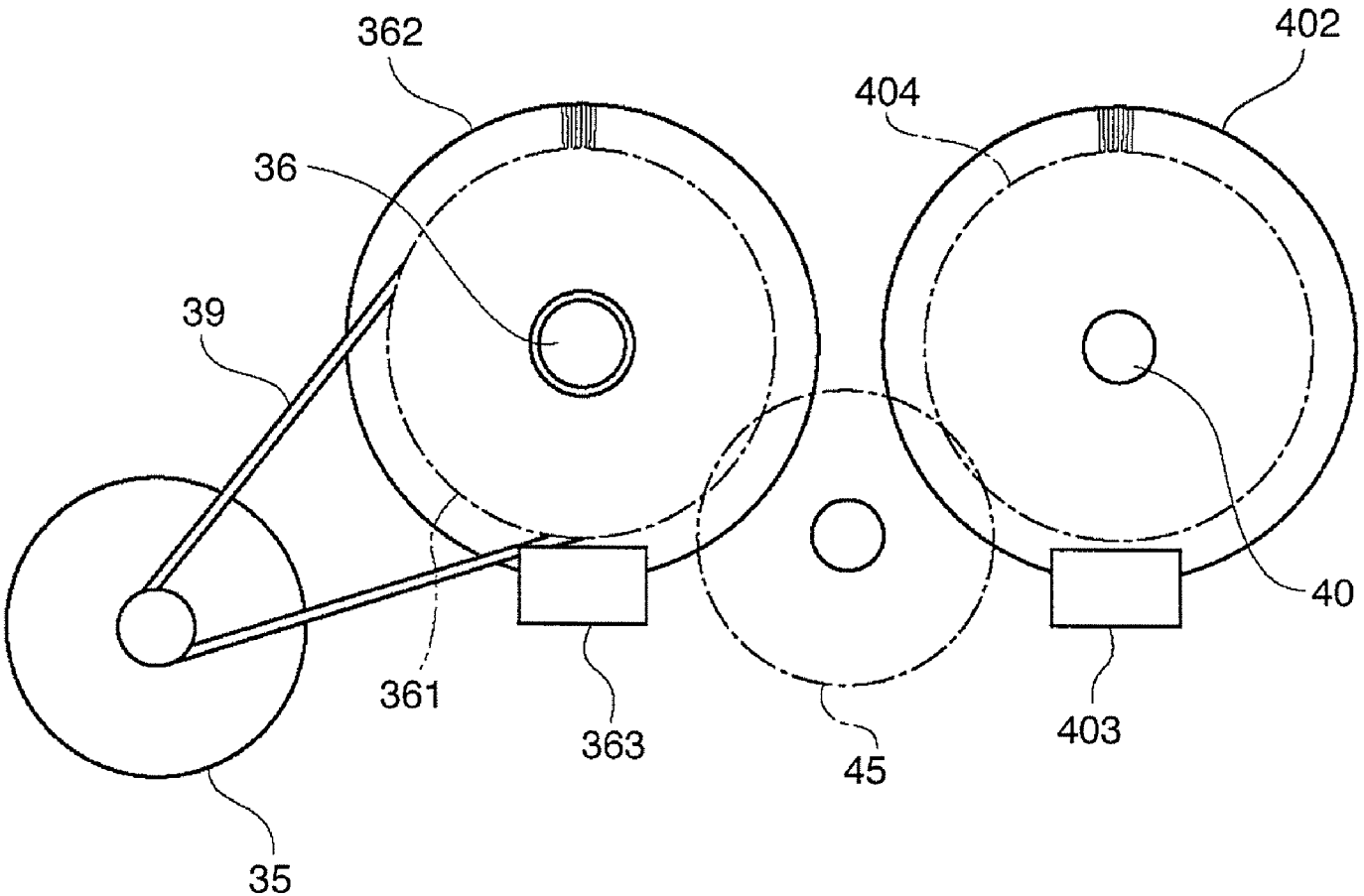
FIG. 4 is a side sectional view showing a conveyance roller and a discharge roller which are included in the printing medium conveyance mechanism and have encoders, respectively.

FIG. 4 is a side sectional view showing a conveyance roller and a discharge roller which are included in the printing medium conveyance mechanism and have encoders, respectively.

The arrangement of the printing apparatus will be described next with reference to FIGS. 1 to 4.

A printing apparatus 1 shown in FIGS. 1 to 4 includes a feeding portion, conveyance portion, carriage portion, and discharge portion. The schematic arrangements of these portions will be described sequentially.

(A) Feeding Portion

A feeding portion 2 shown in FIG. 1 is designed to stack sheet-like printing media (not shown) such as cut sheets on a pressure plate 21, as shown in FIG. 3. In the feeding portion 2, the pressure plate 21, a feed roller 28 to feed a printing medium, and a separation roller 241 to separate each printing medium are attached to a base 20.

A feed tray (not shown) to hold the stacked printing media is attached to the base 20 or housing. The slidably retractable feed tray is pulled out for use.

The feed roller 28 is columnar and has an arc-shaped section. A motor shared by a cleaning unit provided in the feeding portion 2 transmits a driving force to the feed roller 28 via a driving transmitting gear (not shown) and a planet gear (not shown).

A movable side guide 23 is provided on the pressure plate 21 to limit the stack position of printing media. The pressure plate 21 can rotate about a rotating shaft coupled to the base 20. A platen spring (not shown) biases the pressure plate 21 to the feed roller 28. The pressure plate 21 has, on its part facing the feed roller 28, a separation sheet (not shown) made of a material with a large friction coefficient, e.g., artificial leather to prevent erroneous multiple sheets conveyance when the stacked printing media are going to run out. The pressure plate 21 can abut against the feed roller 28 or separate from it via a pressure plate cam (not shown).

The separation roller 241 has a clutch spring (not shown). With a predetermined load or more, the attachment portion of the separation roller 241 can rotate.

In a normal standby state, the stack port is closed not to feed the stacked printing media into the printing apparatus. When feeding starts in this state, the motor is driven to make the separation roller 241 abut against the feed roller 28. The pressure plate 21 also abuts against the feed roller 28. Feeding of the printing media starts in this state. Only a predetermined number of printing media are fed to a nip portion formed by the feed roller 28 and the separation roller 241. The fed printing media are separated at the nip portion. Only the printing medium at the top is fed into the printing apparatus.

When the printing medium reaches a conveyance roller 36 and pinch rollers 37, the pressure plate cam (not shown) returns the pressure plate 21 to the initial position. At this time, the printing medium that has reached the nip portion formed by the feed roller 28 and the separation roller 241 can return to the stack position.

(B) Conveyance Portion

The conveyance portion is attached to a chassis 11 made of a bent metal sheet. The conveyance portion has the conveyance roller 36 for conveying a printing medium, and a PE sensor 32. The conveyance roller 36 is made of a metal shaft with a coating of ceramic micro-particles. The conveyance roller 36 is received by bearings at its metal parts of both ends and attached to the chassis 11. A conveyance roller tension spring (not shown) is inserted between the conveyance roller 36 and each bearing to bias the conveyance roller 36 and apply a predetermined load to it during rotation so that stable conveyance is possible.

The plurality of pinch rollers 37 are abut against and follow the conveyance roller 36. A pinch roller holder (not shown) holds the pinch rollers 37. A pinch roller spring (not shown) biases the pinch rollers 37 to press them against the conveyance roller 36 so that a printing medium conveyance force is generated. The pinch rollers 37 rotate about the rotating shaft of the pinch roller holder, which is attached to the bearings of the chassis 11. A platen 34 is disposed at the entrance of the conveyance portion where a printing medium arrives. The platen 34 is attached to the chassis 11 and positioned.

In the above arrangement, a printing medium fed to the conveyance portion is guided by the pinch roller holder (not shown) and a paper guide flapper and fed to the roller pair of the conveyance roller 36 and pinch rollers 37. At this time, the PE sensor 32 detects the leading edge of the conveyed printing medium whereby the print position of the printing medium is determined. As a conveyance motor (not shown) rotates the pair of rollers 36 and 37, the printing medium is conveyed on the platen 34. Ribs serving as a conveyance reference plane are formed on the platen 34 to manage the gap to the printhead and suppress wave of the printing medium together with the discharge portion to be described later.

As shown in FIG. 4, a conveyance motor 35 formed from a DC motor transmits its rotating force to a pulley 361 provided coaxially on the conveyance roller 36 via a timing belt 39, thereby driving the conveyance roller 36. A cord wheel 362 with markings formed at a pitch of 150 to 300 lpi is provided coaxially on the conveyance roller 36 to detect the conveyance amount by the conveyance roller 36. An encoder sensor 363 to read the markings is attached to the chassis 11 to be adjacent to the cord wheel 362.

As described above, a characteristic feature of this embodiment is to include a plurality of cord wheels and encoder sensors in a single mechanism, and convey a printing medium P while changing the object of control for each conveyance area of the printing medium P on the basis of the outputs from the plurality of encoder sensors in conveyance control using one conveyance motor serving as a driving source.

This arrangement is advantageous in its low cost because only one driving source is used. This conveyance mechanism can directly control a necessary object of control in an area where accurate control is necessary. Since a chain of drives is formed, the behavior in switching the object of control stabilizes. Unlike an arrangement having a plurality of driving sources, advanced synchronous control of a plurality of rollers is unnecessary.

A printhead 7 used for forming an image on the basis of image information is provided downstream in the printing medium conveyance direction of the conveyance roller 36.

As the printhead 7, an inkjet printhead including color ink tanks 71 that are individually exchangeable is used. The printhead 7 discharges ink from nozzles to form an image on a printing medium as the ink film-boils upon receiving heat from, e.g., a heater and creates bubbles which grow or shrink to change the pressure. At this time, the platen 34 holds the printing medium to maintain a predetermined distance between its print surface and the nozzles.

An absorbent material 344 is provided on the platen 34 to absorb ink overflowing from the edge of a printing medium in full print (marginless print). The absorbent material 344 absorbs ink overflowing from all four edges of a printing medium.

(C) Carriage Portion

A carriage portion 5 has a carriage 50 to which the printhead 7 is attached. A guide shaft 52 that reciprocally scans in a perpendicular direction (different direction) to the printing medium conveyance direction and a guide rail (not shown) which holds the rear end of the carriage 50 to maintain the gap between the printhead 7 and a printing medium support the carriage 50. The guide shaft 52 is attached to the chassis 11. The guide rail is integrated with the chassis 11.

A carriage motor 54 attached to the chassis 11 drives the carriage 50 via a timing belt 541. The timing belt 541 connects to the carriage 50 via a damper made of, e.g., rubber and reduces the density unevenness in images by attenuating vibrations of the carriage motor 54 and the like. A cord strip 561 with markings formed at a pitch of 150 to 300 lpi is provided parallel to the timing belt 541 to detect the position of the carriage 50. An encoder sensor (not shown) to read the markings is provided on a carriage substrate (not shown) provided in the carriage 50. The carriage 50 also has a flexible substrate 57 to transmit various kinds of control signals and print signals from a control circuit (to be described later) to the printhead 7.

A head set lever 51 is provided to fix the printhead 7 to the carriage 50. The printhead 7 is fixed to the carriage 50 by turning the head set lever 51 about its fulcrum.

To form an image on a printing medium, the pair of rollers 36 and 37 convey a printing medium to the ink discharge position of the printhead 7 along the printing medium conveyance direction. Simultaneously, the carriage motor 54 moves the carriage 50 to the ink discharge position along the carriage moving direction. The printhead 7 discharges ink to the printing medium in accordance with a control signal from the control circuit, thereby forming an image.

(D) Discharge Portion

The discharge portion includes two discharge rollers 40 and 41, a spur (not shown) that abuts against the discharge rollers 40 and 41 at a predetermined pressure and rotates with them, and a series of gears to transmit the driving force of the conveyance roller to the discharge rollers 40 and 41. The discharge rollers 40 and 41 are attached to the platen 34. The discharge roller 40 has a plurality of rubber parts on its metal shaft.

As shown in FIG. 4, the discharge roller 40 is driven as the drive of the conveyance roller 36 acts, via an idler gear 45, on a discharge roller gear 404 directly connected to the discharge roller 40. The discharge roller 41 provided downstream of the discharge roller 40 in the printing medium conveyance direction is made of a resin. Driving force to the discharge roller 41 is transmitted from the discharge roller 40 via another idler gear. A cord wheel 402 with markings formed at a pitch of 150 to 300 lpi is provided coaxially on the discharge roller 40 to detect the conveyance amount by the discharge roller 40. An encoder sensor 403 to read the markings is attached to the chassis 11 to be adjacent to the cord wheel 402.

The spur is attached to a spur holder 43.

With the above-described arrangement, the printing medium printed by the printhead 7 is pinched at the nip between the spur and the discharge roller 41, conveyed, and discharged to a discharge tray 46. The discharge tray 46 is retractable into a front cover 95. For use, the discharge tray 46 is pulled out. The discharge tray 46 has an ascending slope and vertical projections at two ends to easily stack discharged printing media and prevent friction of printed surfaces.

Figure 5:
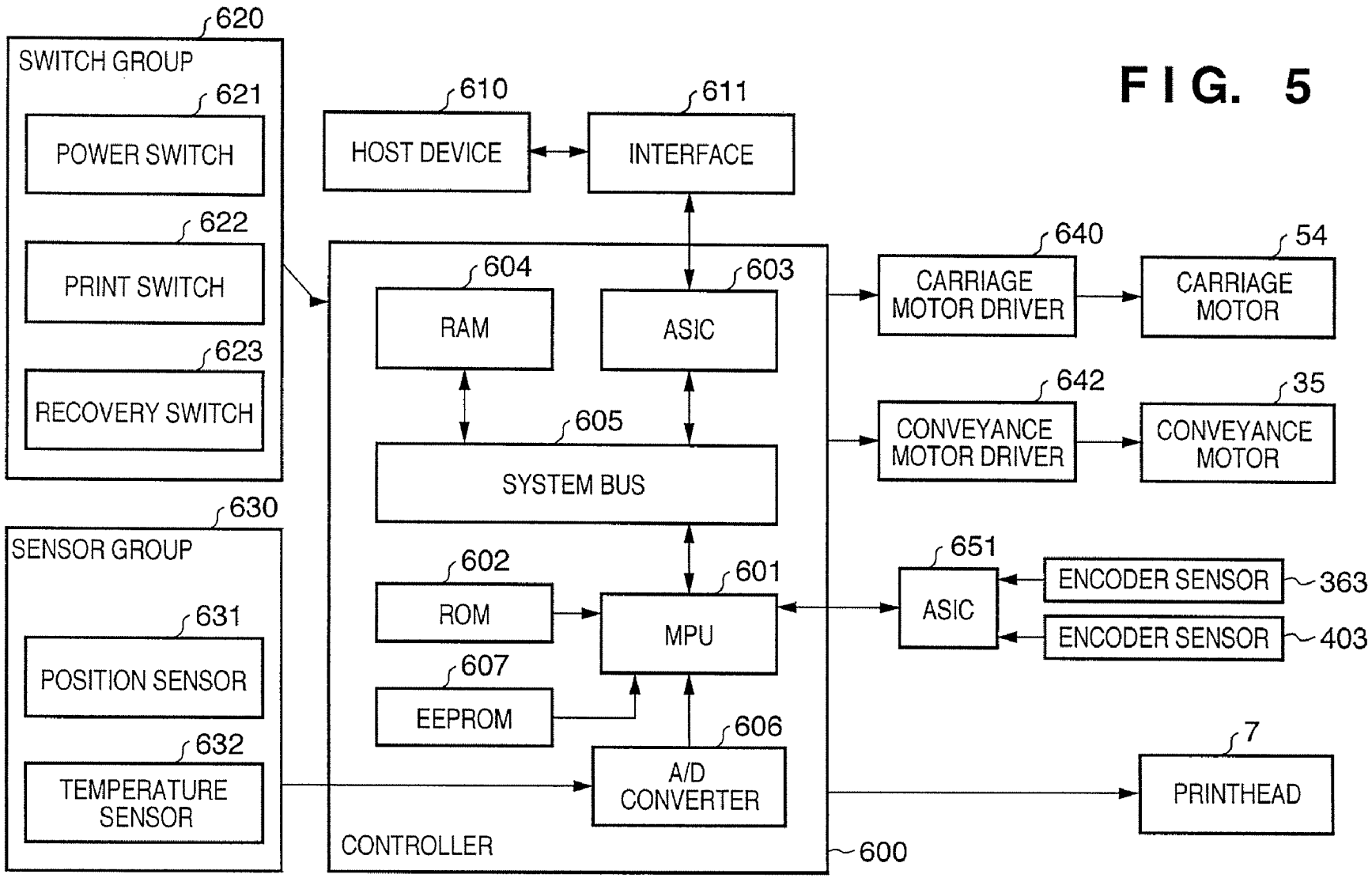
FIG. 5 is a block diagram showing the control arrangement of the printing apparatus shown in FIGS. 1 to 4.

FIG. 5 is a block diagram showing the control arrangement of the printing apparatus shown in FIGS. 1 to 4.

As shown in FIG. 5, a controller 600 has an MPU 601, ROM 602, ASIC (Application Specific Integrated Circuit) 603, RAM 604, and A/D converter 606. The ROM 602 stores programs corresponding to control sequences to be described later, necessary tables, and other fixed data. The ASIC 603 generates control signals to control the carriage motor 54, conveyance motor 35, and printhead 7. The RAM 604 has, e.g., an image data rasterization area and a work area for program execution. The MPU 601, ASIC 603, and RAM 604 connect to each other via a system bus 605 to exchange data. The A/D converter 606 receives analog signals from a sensor group to be described below, A/D-converts them, and supplies the A/D converted digital signals to the MPU 601. Note that when printing an adjustment pattern, the ASIC 603 processes data read from the ROM 602, and transfers the processed data to the printhead.

Referring to FIG. 5, a computer (or a reader for image reading or a digital camera) 610 serving as an image data supply source is generically called a host device. The host device 610 and the printing apparatus 1 exchange image data, commands, and status signals via an interface (I/F) 611. The MPU 601 not only performs printing operation based on commands and image data sent from the host apparatus 610, but also performs printing operation based on an adjustment pattern to be described later.

A switch group 620 includes a power switch 621, a print switch 622 that gives the instruction to start printing, and a recovery switch 623 that gives the instruction to activate a process (recovery process) to maintain high ink discharge performance of the printhead 7. The printing apparatus receives an operator's instruction inputs from these switches. A sensor group 630 includes a position sensor 631 such as a photocoupler to detect a home position, and a temperature sensor 632 provided at an appropriate position of the printing apparatus to detect the ambient temperature.

As described in detail later, two encoders are provided on the conveyance roller 36 and the discharge roller 40, respectively, and each encoder outputs a signal according to a rotation of its associated roller. This signal is outputted to a controller which performs conveyance control.

The encoder sensors 363 and 403 read the markings on the cord wheels 362 and 402 provided on the conveyance roller 36 and discharge roller 40, respectively, and generate encoder signals (analog signals). Each of the encoder sensors 363 and 403 generates an edge signal by detecting the signal edge of the generated encoder signal and A/D-converts the edge signal to generate a digital pulse signal. Based on the pulse signal, information on the rotation amounts and rotational speeds of the conveyance roller 36 and discharge roller 40 can be obtained. The markings on the cord wheels 362 and 402 are formed at a predetermined pitch. For this reason, the pulse signals are generated at a predetermined period as long as the conveyance roller 36 and discharge roller 40 normally rotate at a predetermined rotational speed.

The encoder sensors 363 and 403 output the pulse signals to an ASIC 651. Under the control of the MPU 601, the ASIC 651 counts the number of pulses of each of the pulse signals from the encoder sensors 363 and 403, detects the phase difference between the pulse signals, or measures the period of each pulse signal. The measurement and detection results are output to the MPU 601.

A carriage motor driver 640 drives the carriage motor 54 to reciprocally scan the carriage 50. A conveyance motor driver 642 drives the conveyance motor 35 to convey a printing medium.

An EEPROM 607 stores a conveyance correction amount to be described later.

In print scan of the printhead 7, the ASIC 603 transfers the drive data (DATA) of printing elements (discharge heaters) to the printhead while directly accessing a storage area of the RAM 604.

In the arrangement shown in FIGS. 1 to 4, the ink cartridges 71 and the printhead 7 are separable. They may integrate and form an exchangeable head cartridge instead.

The controller 600 shown in FIG. 5 may include the ASIC 651. In this case, the ASIC 651 may be omitted. Instead, a part of the controller 600, for example, the ASIC 603 may process pulse signals from the encoder sensors 363 and 403 in place of the ASIC 651.

An example will be described next in detail in which printing medium conveyance control is performed on the basis of outputs from a plurality of encoder sensors provided in the conveyance mechanism of the printing apparatus.

Figure 6A:
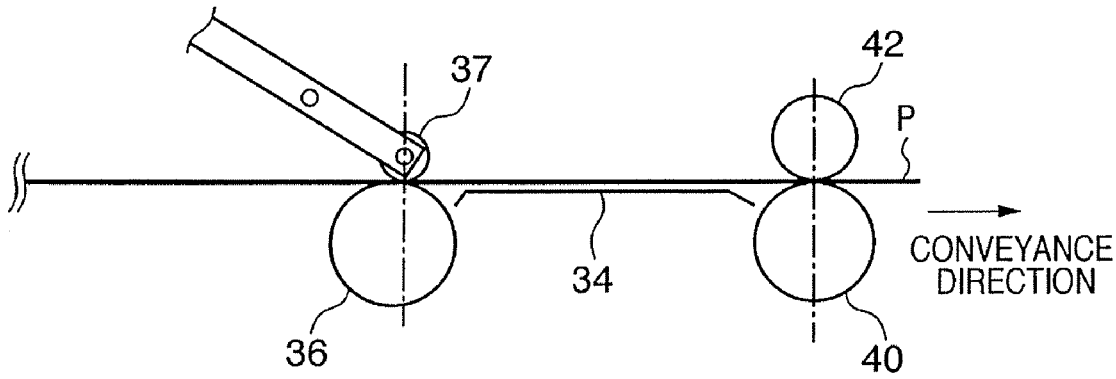
FIGS. 6A to 6C are schematic views showing the progress of conveyance operation in printing an adjustment pattern.
Figure 6B:
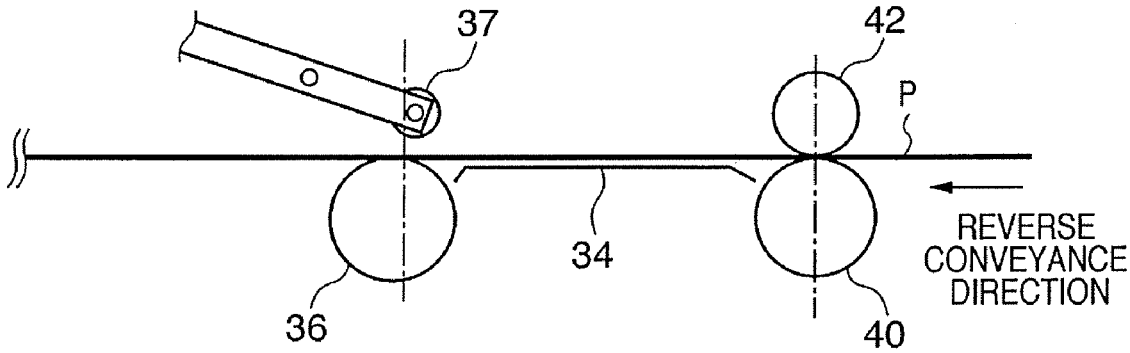
Figure 6C:
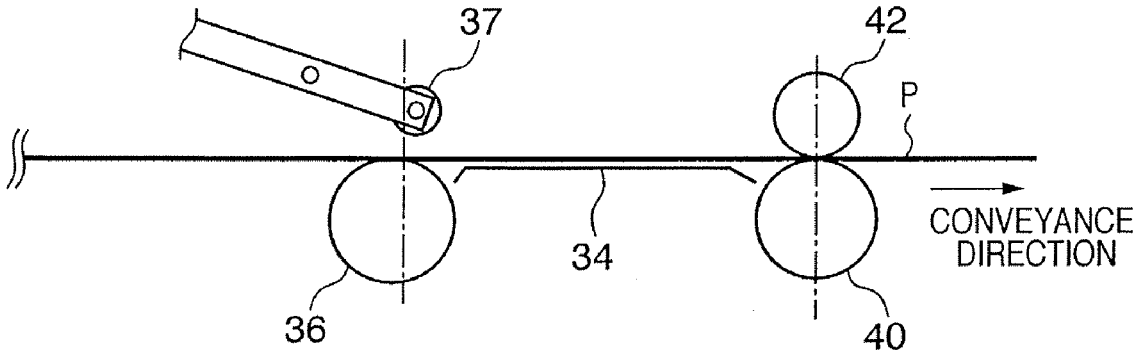

FIGS. 6A to 6C are schematic views showing the progress of conveyance operation in printing an adjustment pattern.

Figure 7:
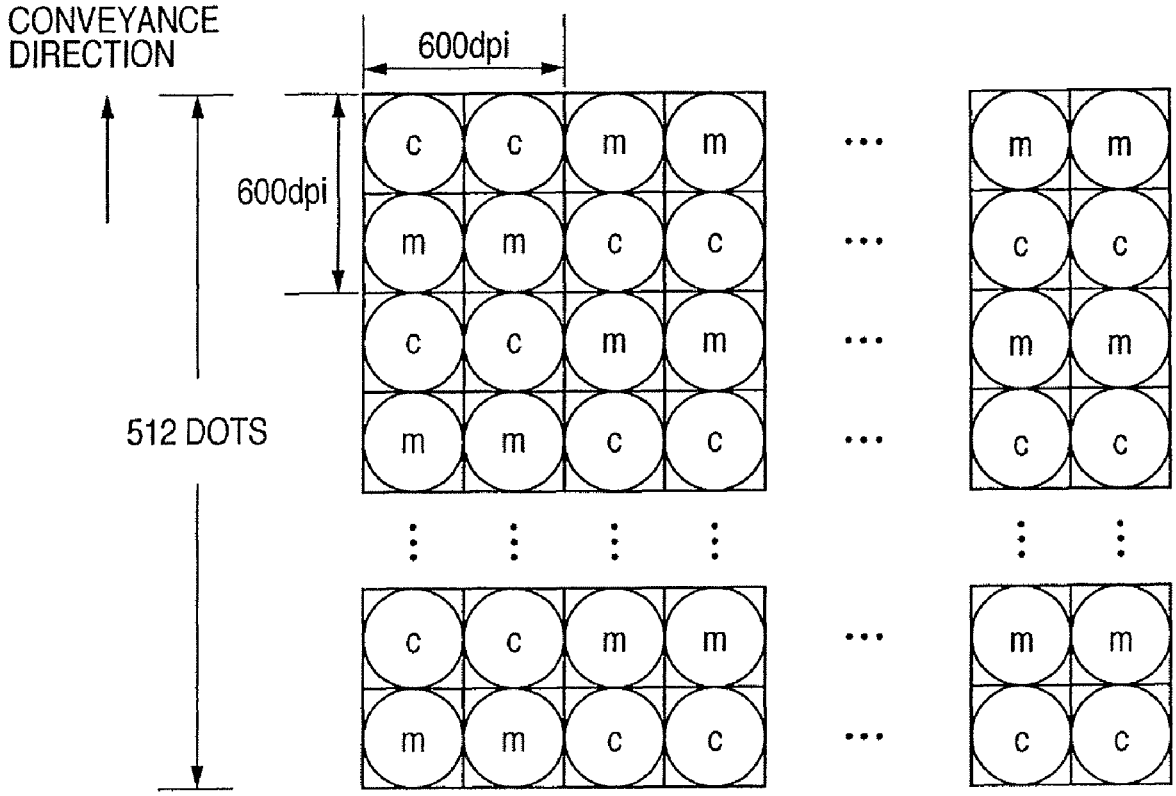
FIG. 7 is a view showing a detailed arrangement of an adjustment pattern.

FIG. 7 is a view showing a detailed arrangement of an adjustment pattern.

Figure 8:
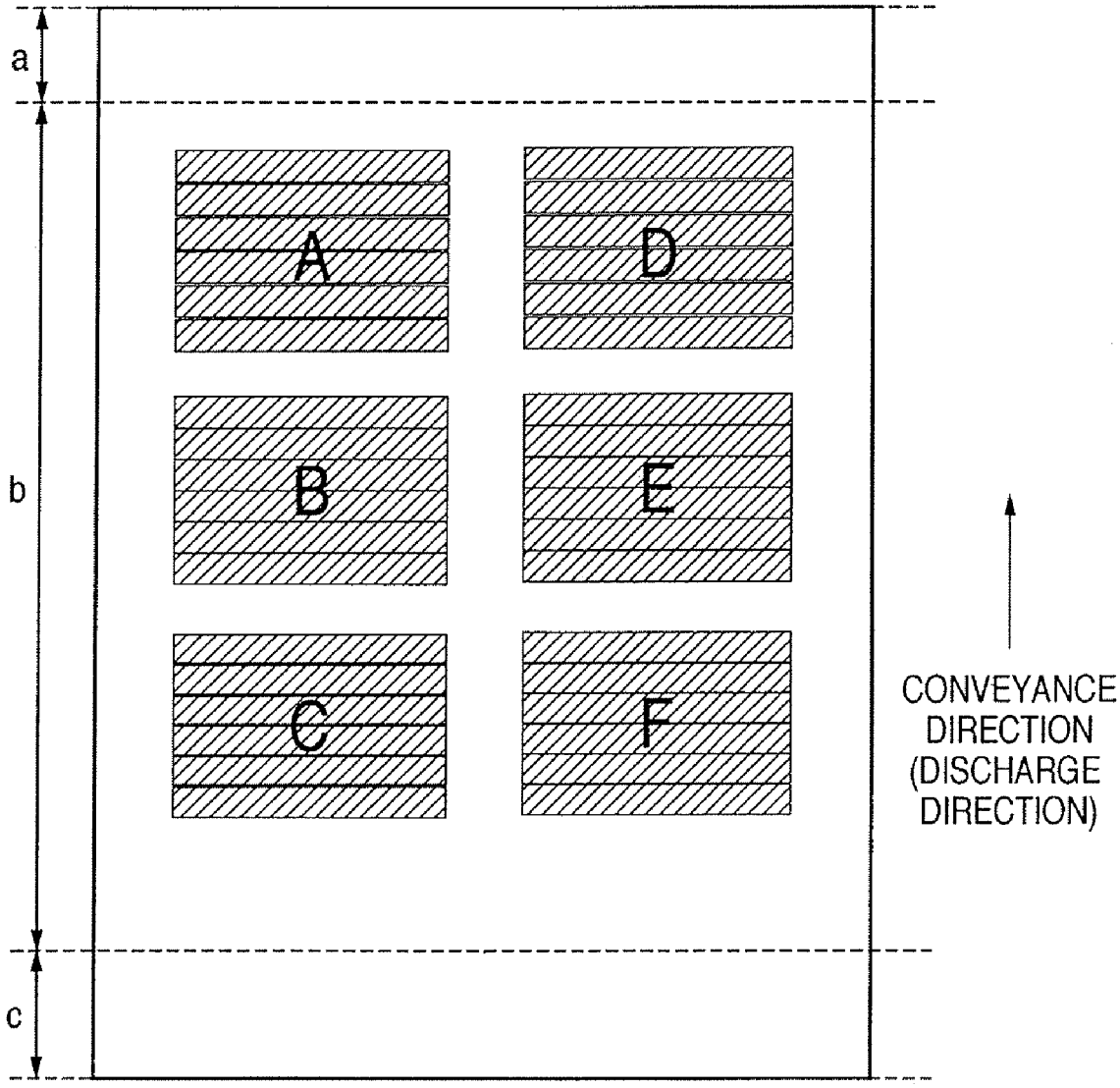
FIG. 8 is a view showing an adjustment pattern printing area on a printing medium.

FIG. 8 is a view showing an adjustment pattern printing area on a printing medium.

Conveyance amount correction according to this embodiment is performed for the purpose of improving the quality of a printed image. The conveyance amount is corrected in image printing using dye inks.

As shown in FIGS. 6A to 6C, the combination of conveyance rollers involved in the conveyance operation normally changes depending on which printing medium area is passing through the conveyance mechanism.

For example, as shown in FIG. 8, when a printing medium is fed, and a leading edge portion a of the printing medium has reached the conveyance roller 36 in the printing medium conveyance direction, only the conveyance roller 36 gets involved in conveyance of the printing medium. When the printing operation (conveyance) progresses, and the printing apparatus prints a wide intermediate area b of the printing medium, both the conveyance roller 36 and the discharge roller 40 get involved in conveyance of the printing medium. When the printing medium passes through the conveyance roller 36, and the printing apparatus prints a trailing edge portion c of the printing medium, only the discharge roller 40 gets involved in conveyance of the printing medium. More specifically, in conveyance control upon printing the leading edge portion a and area b, the conveyance motor 35 is controlled on the basis of the encoder sensor 363. In conveyance control upon printing the trailing edge portion c, the conveyance motor 35 is controlled on the basis of the encoder sensor 403.

This conveyance operation will be described in more detail with reference to FIGS. 6A to 6C.

Upon receiving an adjustment pattern print start instruction, the printing apparatus takes in a printing medium P that is separated and fed from the feeding portion 2 and stops the printing medium P at a predetermined position.

As shown in FIG. 6A, the printing medium P receives a conveyance force from the entire conveyance mechanism including the conveyance roller (main conveyance roller) 36 and the discharge roller 40. This state does not change until adjustment patterns A to C shown in FIG. 8 are completely printed. Hence, a constant conveyance force is always applied to the printing medium P during the adjustment pattern printing.

Next, the printhead 7 discharges cyan ink and magenta ink to print a dot pattern with a uniform density corresponding to 512 nozzles as shown in FIG. 7. The adjustment patterns A to C shown in FIG. 8 are printed by repeating printing medium conveyance corresponding to the print width and dot pattern printing. It should be noted that the printing medium conveyance amount after the dot pattern printing slightly changes between the adjustment patterns A to C shown in FIG. 8. The conveyance amount is set to become large in the order of adjustment patterns A, B, and C. More specifically, on the basis of the output result of the encoder sensor 363 for the cord wheel 362, the conveyance amount of the adjustment pattern A is larger than that of the adjustment pattern B by 5 μm per conveyance operation. Likewise, the rotation amount of the conveyance motor 35 is adjusted such that the conveyance amount of the adjustment pattern C becomes smaller than that of the adjustment pattern B by 5 μm per conveyance operation.

The rotation amount of the conveyance motor 35 for the conveyance operation has a numerical value that is given in consideration of even, e.g., the decrease in conveyance amount due to slip between the printing medium P and the conveyance roller 36 and slip between the printing medium P and discharge roller 40. For this reason, the conveyance amount in, e.g., the area to print the adjustment pattern B does not always have a theoretical value of an optimum feed amount obtained from the rotation angle and circumference of the conveyance roller 36. The difference is not limited to "5 μm", either. An appropriate value should be set on the basis of the diameter tolerance of the conveyance roller 36, and an adjustment width to appropriately adjust the individual differences of apparatuses may be set.

As shown in FIG. 6B, the pinch roller 37 is lifted up by a pinch roller elevating mechanism (not shown), and the printing medium P is conveyed in a reverse direction. This operation is performed to execute printing at the same position as the adjustment pattern A in the conveyance direction in the intermediate area (area b in FIG. 8) of the printing medium. The conveyance amount in the conveyance operation in the reverse direction is set such that the leading edge (an end portion on the downstream side in the conveyance direction) of the printing medium P is not located on the upstream side of the discharge roller 40 (the left side of the discharge roller 40 in FIG. 6B) when stopping the conveyance operation (the amount is set to a value at which the printing medium does not pass through the discharge roller). The pinch roller 37 is lifted up in reverse conveyance to prevent the printed printing medium P from abutting against the pinch roller 37. If the printing medium P contacts the pinch roller 37, undried ink is transferred to the pinch roller 37 and then to the printing medium P again and soils it. If there is no possibility of soil, the pinch roller 37 may be lifted up after the printing medium P is conveyed in the reverse direction.

As shown in FIG. 6C, adjustment patterns D to F with the same dot pattern arrangement as the adjustment patterns A to C are printed while conveying the printing medium P in the conveyance direction. All necessary adjustment patterns are thus printed on one printing medium. As is apparent from FIGS. 6C and 8, the adjustment patterns D to F are printed in the intermediate area b of the printing medium, and the pinch roller 37 is kept lifted up. That is, the pinch roller 37 is spaced apart from the conveyance roller 36. Hence, the conveyance force from the conveyance roller 36 is not applied to the printing medium P. The printing medium P is conveyed by only the conveyance force from the discharge roller 40 and spur.

In printing the adjustment patterns D to F, the printing medium P is conveyed by only the conveyance force from the discharge roller, and the conveyance roller 36 does not contribute to conveyance. Due to the sliding resistance between the printing medium P and the conveyance roller 36, the conveyance length is shortened, compared to actual printing in the area c. Hence, a predetermined correction amount is added to the required theoretical discharge roller rotation amount obtained from the output result of the encoder sensor 403.

The conveyance amount difference of the adjustment pattern D to the adjustment pattern E is +13.1 μm. The conveyance amount difference of the adjustment pattern F to the adjustment pattern E is −13.1 μm. This conveyance amount difference is larger than that in conveyance for the adjustment patterns A to C. This is because the adjustment range must be wider since the diameter tolerance of the discharge roller 40 is larger than that of the conveyance roller 36. Thus, the printing apparatus has, as the conveyance operation modes to print the adjustment patterns, a first mode in which a printing medium is conveyed by using the conveyance roller and discharge roller and a second mode in which a printing medium is conveyed by using the discharge roller.

Finally, a pattern whose print density change caused by the conveyance operation is minimum is visually selected from the discharged printing medium P with the printed adjustment patterns. The selection result is stored in the printing apparatus by, e.g., key input, thereby determining the optimum correction amount. The correction amount determines the driving amount of the motor in one conveyance operation in the printing operation based on image data. The driving amount is expressed by, e.g., the number of slits of an encoder. The driving amount is determined by visually observing the adjustment patterns. That is, the driving amount in conveyance using the conveyance roller and discharge roller is determined by visually observing the patterns A, B, and C. This is, e.g., the correction amount of the number of slits of the cord wheel 362. Next, the driving amount in conveyance using the discharge roller is determined by visually observing the patterns D, E, and F. This is, e.g., the correction amount of the number of slits of the cord wheel 402. If the printing apparatus has input keys, the selection result is input by using the input keys. If the printing apparatus has no input keys, the selection result is input from, e.g., the keyboard of a host device connected to the printing apparatus.

When the correction amount is too small, the adjustment patterns overlap, and the user sees horizontal lines with high density. On the other hand, when the correction amount is too large, gaps are formed, and the user sees the ground color of the printing medium P. The user particularly discriminates an adjustment pattern block with a small density unevenness at the conveyance position from the adjustment patterns A to C and D to F as a guideline for selection.

When the key input is ended, the printing apparatus determines the correction amount of the conveyance amount on the basis of the selection result. Until a new value is input via the keys, the EEPROM 607 stores the correction amount. The conveyance amount is corrected on the basis of the correction amount. In this embodiment, so-called plain paper is used as a printing medium to print the adjustment patterns. The correction amount for a printing medium of another type is determined by, e.g., multiplying the correction amount obtained for plain paper by a predetermined coefficient corresponding to the type of the printing medium. That is, it is unnecessary to always print adjustment patterns on printing media of all types.

In this embodiment, three adjustment patterns in a certain conveyance state are printed in different conveyance amounts. However, the present invention is not limited to this. For example, the conveyance amount difference between the adjustment patterns may be made smaller, and the number of adjustment patterns to be printed may be increased. Alternatively, the adjustment patterns may be divisionally printed on a plurality of printing media.

If the required conveyance accuracy of the conveyance roller 36 is sufficiently ensured, printing of only the adjustment patterns D, E, and F for the discharge roller suffices. It is unnecessary to execute adjustment for all conveyance rollers.

According to the above-described embodiment, even when the printing medium P is conveyed by only the discharge roller, the conveyance amount is appropriately corrected. For this reason, accurate conveyance control is implemented throughout the entire area of the printing medium. Consequently, a high-quality image can be printed.

In each adjustment pattern used in this embodiment, the conveyance-direction length of the area is not particularly defined. However, for example, an adjustment pattern with a predefined conveyance-direction length is also usable.

Figure 9:
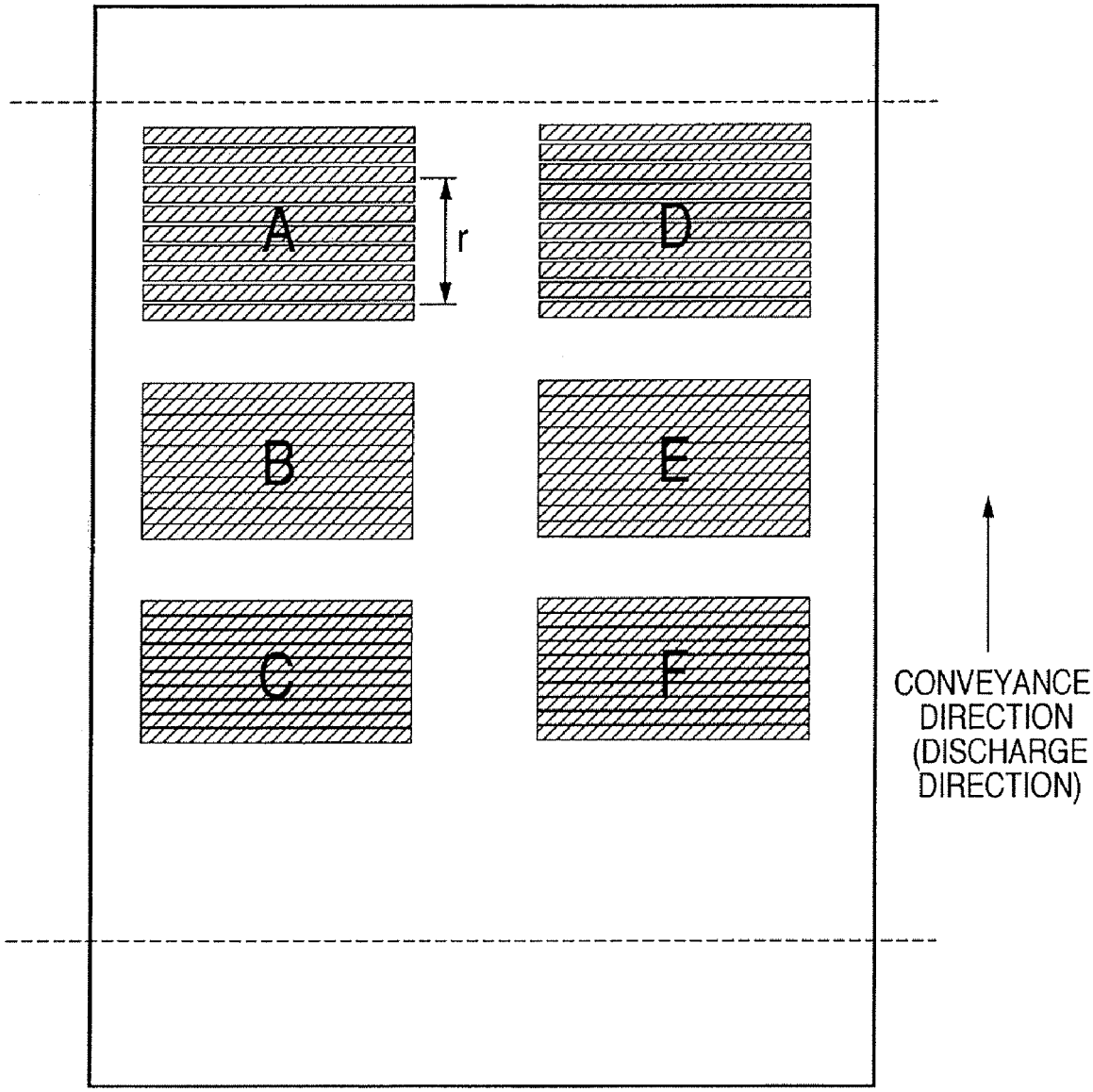
FIG. 9 is a view showing another example of an adjustment pattern printing area on a printing medium.

FIG. 9 is a view showing another example of an adjustment pattern printing area on a printing medium.

As shown in FIG. 9, the conveyance-direction length of an adjustment pattern is made longer than a circumference r of the conveyance roller to be adjusted. While conveying a printing medium in steps of r/8, the adjustment pattern is printed in a length equal to or more than one revolution of the conveyance roller. This makes it possible to detect even the eccentricity of the conveyance roller from the density unevenness at each conveyance position.

On the basis of the result, a pattern for which satisfactory conveyance accuracy is obtained on average by a plurality of number of times of conveyance is selected. This makes it possible to correct the conveyance amount in consideration of the eccentricity.

In the above-described embodiment, to obtain an optimum correction value from the adjustment pattern printing result, the user visually discriminates and selects an optimum adjustment pattern. However, the present invention is not limited to this. For example, the printing apparatus may perform automatic discrimination by causing a sensor mounted on the carriage to read each adjustment pattern.

More specifically, for example, after adjustment patterns are printed, the printing medium is conveyed in a reverse direction. Then, a sensor mounted on the carriage reads the adjustment patterns while conveying the printing medium in the discharge direction. An adjustment pattern with a minimum density variation is selected, thereby determining the optimum adjustment value. For example, in an apparatus called a multi functional peripheral that integrates a printing apparatus and an image reading apparatus, the image reading apparatus may read adjustment patterns in place of the sensor, and the optimum adjustment value may be determined on the basis of the reading result.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-227016, filed Aug. 23, 2006, which is hereby incorporated by reference herein in its entirety.

What is claimed is:

1. A printing apparatus which includes scanning means for moving a printhead in a predetermined direction and causes the printhead to print on a printing medium while causing the scanning means to move the printhead, the apparatus comprising:

conveyance means, operable in either a first conveyance mode or a second conveyance mode, for conveying a printing medium in a conveyance direction different from the predetermined direction, wherein said conveyance means includes: a first conveyance roller, provided in a conveyance path of the printing medium, for conveying the printing medium; and a second conveyance roller, provided in the conveyance path of the printing medium at a downstream side from said first conveyance roller with respect to the conveyance direction of the printing medium, for conveying the printing medium, wherein the conveyance is performed in the first conveyance mode by using said first conveyance roller and said second conveyance roller while a pinch roller is pressed against said first conveyance roller, and the conveyance is performed in the second conveyance mode by using said second conveyance roller while the pinch roller is spaced apart from said first conveyance roller;

pattern printing means for printing a pattern having a predetermined uniform density in the conveyance direction on the printing medium a plurality of number of times by using the printhead while conveying the printing medium by executing the first conveyance mode and the second conveyance mode and changing a conveyance amount by the conveyance means by a predetermined amount each time one pattern is printed;

storage means for storing a first conveyance correction amount obtained from a conveyance amount in executing the first conveyance mode and a second conveyance correction amount obtained from a conveyance amount in executing the second conveyance mode as a conveyance correction amount obtained on the basis of a conveyance amount upon printing a pattern selected from a plurality of patterns printed by said pattern printing means; and conveyance control means for controlling conveyance of the printing medium while correcting the conveyance amount of the printing medium by said conveyance means on the basis of the first conveyance correction amount stored in said storage means so as to print on the printing medium based on image data until the printing medium passes through said first conveyance roller, and further controlling conveyance of the printing medium while correcting the conveyance amount of the printing medium by said conveyance means on the basis of the second conveyance correction amount stored in said storage means after the printing medium has passed through said first conveyance roller.

2. The apparatus according to claim 1, further comprising:

a first encoder, provided on said first conveyance roller, for outputting a signal in accordance with rotation of said first conveyance roller; and a second encoder, provided on said second conveyance roller, for outputting a signal in accordance with rotation of said second conveyance roller.

3. The apparatus according to claim 1, wherein the printing medium is a cut sheet, and printing by said pattern printing means is performed at a central portion of the cut sheet in an area where the cut sheet is conveyed by both said first conveyance roller and said second conveyance roller.

4. The apparatus according to claim 2, wherein said first conveyance roller and said second conveyance roller are driven by a single motor.

5. The apparatus according to claim 1, wherein selection from the plurality of patterns printed by said pattern printing means is made by visually selecting a pattern with a minimum density variation by a user.

6. The apparatus according to claim 5, further comprising input means for inputting the pattern selected by the user to the printing means.

7. The apparatus according to claim 1, further comprising:

reading means for reading the plurality of patterns printed on the printing medium by said pattern printing means; and selection means for selecting a pattern with a minimum density variation from the plurality of patterns read by said reading means.

8. The apparatus according to claim 1, wherein a length of the pattern printed by said pattern printing means in the conveyance direction length of the printing medium is longer than a circumference of said second conveyance roller.

9. The apparatus according to claim 1, wherein said conveyance control means corrects the conveyance amount by said second conveyance roller on the basis of the conveyance correction amount stored in said storage means in an area where the printing medium is conveyed by only said second conveyance roller.

10. A conveyance control method of a printing apparatus which includes conveyance means for conveying a printing medium, and scanning means for reciprocally moving a printhead in a direction different from a conveyance direction by the conveyance means including: a first conveyance roller, provided in a conveyance path of the printing medium, for conveying the printing medium; and a second conveyance roller, provided in the conveyance path of the printing medium at a downstream side from the first conveyance roller with respect to the conveyance direction of the printing medium, for conveying the printing medium wherein the conveyance means is operable in either a first conveyance mode in which a pinch roller is pressed against the first conveyance roller, or a second conveyance mode in which the pinch roller is spaced apart from the first conveyance roller, and causes the printhead to print on the printing medium, the method comprising steps of:

printing a pattern having a predetermined uniform density on the printing medium a plurality of number of times by using the printhead while conveying the printing medium by executing the first conveyance mode and the second conveyance mode and changing a conveyance amount by the conveyance means by a predetermined amount each time one pattern is printed;

storing a first conveyance correction amount obtained from a conveyance amount in executing the first conveyance mode and a second conveyance correction amount obtained from a conveyance amount in executing the second conveyance mode, in a storage medium, a conveyance correction amount obtained on the basis of a conveyance amount upon printing a pattern selected from a plurality of patterns printed in the pattern printing step; and controlling conveyance of the printing medium while correcting the conveyance amount of the printing medium by the conveyance means on the basis of the first conveyance correction amount stored in the storage medium so as to print on the printing medium based on image data until the printing medium passes through the first conveyance roller, and further controlling conveyance of the printing medium while correcting the conveyance amount of the printing medium by the conveyance means on the basis of the second conveyance correction amount stored in the storage medium after the printing medium has passed through the first conveyance roller.

* * * * *